United States Patent [19]

Mason

[11] Patent Number: 4,497,186

[45] Date of Patent: Feb. 5, 1985

[54] EARRING WITH PENDANT AND CIRCUMJACENT SPIRAL PORTION

[76] Inventor: Harry N. Mason, 1900 Green St., San Francisco, Calif. 94123

[21] Appl. No.: 526,395

[22] Filed: Aug. 25, 1983

[51] Int. Cl.[3] ..... A44C 7/00

[52] U.S. Cl. ..... 63/13; D11/45; D11/78

[58] Field of Search ..... 63/12, 13, 15; D11/43, D11/44, 45, 78

[56] References Cited

U.S. PATENT DOCUMENTS

| | | | |
|---|---|---|---|
| D. 170,963 | 12/1953 | Chernow | D11/43 |
| D. 175,867 | 10/1955 | Sutain | D45/9 |
| D. 239,046 | 3/1976 | Pintarelli | D45/9 |
| 274,583 | 3/1883 | Fowler | 63/12 X |
| 280,726 | 7/1883 | Dutemple | 24/112 |
| 2,033,943 | 3/1936 | Lely | D11/78 X |
| 2,258,413 | 10/1941 | Koven | 63/15 X |
| 2,629,989 | 3/1953 | McDonald | 63/13 |
| 3,071,938 | 1/1963 | Davidson | 63/12 |
| 3,260,068 | 7/1966 | Micallef | 63/12 |
| 3,446,033 | 5/1969 | Driscoll | 63/12 |
| 4,214,456 | 7/1980 | Hannum | 63/12 |

FOREIGN PATENT DOCUMENTS

| | | | |
|---|---|---|---|
| 1712 | of 1885 | United Kingdom . | |
| 809579 | 2/1959 | United Kingdom . | |
| 2099284 | 12/1982 | United Kingdom | 63/12 |

*Primary Examiner*—F. Barry Shay

*Attorney, Agent, or Firm*—Owen, Wickersham & Erickson

[57] ABSTRACT

An earring for pierced ears includes a central pendant portion to hang down from the ear, a curved apex portion extending from the top of the pendant portion, and a spiral portion integral with and extending down from the apex portion. The spiral portion has at least one spiral revolution which surrounds the central pendant portion. Both the pendant portion and the spiral portion provide ornamentation in the earring, while the spiral portion also acts as a hanger wire for the earring, having a lower end which is inserted through the ear so that the earring is rotated spirally until the apex portion hangs in the ear.

5 Claims, 5 Drawing Figures

EARRING WITH PENDANT AND CIRCUMJACENT SPIRAL PORTION

BACKGROUND OF THE INVENTION

This invention relates to earrings, and more particularly to an earring for pierced ears, the earring being of the general type wherein a pendant hangs down from the ear.

Earrings for pierced ears have appeared in a wide variety of configurations. See, for example, U.S. Pat. Nos. 4,214,456, 3,446,033, 3,260,068, 3,071,938, 280,726, Des. 239,046 and Des. 175,867. See also British Pat. Nos. 1721 and 809,579.

Several of the above-listed patents show spiral or helical wire portions on earrings, to be threaded through the ear in a spiral motion, including British Pat. No. 1712 and U.S. Pat. No. 280,726. However, none of these prior patents shows a spiral or helical portion which serves as or is a part of the attachment wire and also comprises an ornamental part of the earring. Primarily, the above-cited prior art shows contortions on the ends of hanger wires, for the purpose of retaining the earring on the ear and not for ornamentation. Davidson U.S. Pat. No. 3,071,938 shows a hookshaped portion which goes through the ear and which would be partially visible from certain angles when the earring is worn.

None of the prior art shows an earring with a hanger wire comprising an ornamental spiral or helical portion which is threaded through the ear to form a part of the securement device, and with a pendant portion of the earring passing through the coils of the spiral, as in the present invention described below.

SUMMARY OF THE INVENTION

The present invention is an earring of very attractive appearance, wherein a principal ornamental feature also forms a part of the attachment means. The earring comprises a central pendant portion to hang down from the ear, a curved apex portion extending from the top of the pendant portion, and a spiral portion integral with and extending down from the apex portion. The spiral portion has at least one spiral or helical revolution circumjacent the central pendant portion, said spiral portion comprising both a hanger wire for the earring and an ornamental portion of the earring. The spiral portion terminates in the lower end which is insertable through the ear and fed in spirally up to the apex portion, for attaching the earring to the ear. The central pendant portion may be integral with the apex portion and the spiral portion, or connected to a depending end of the apex portion. It may comprise an elongated, generally flat pendant.

Accordingly, it is among the objects of the invention to provide a simple yet very attractive earring which is unusual in appearance and which has a decorative portion which also serves as at least a part of the attachment device for the earring. These and other objects, advantages, features and characteristics of the invention will be apparent from the following description preferred embodiments, considered along with the accompanying drawings.

DESCRIPTION OF PREFERRED EMBODIMENTS

Figure 1:
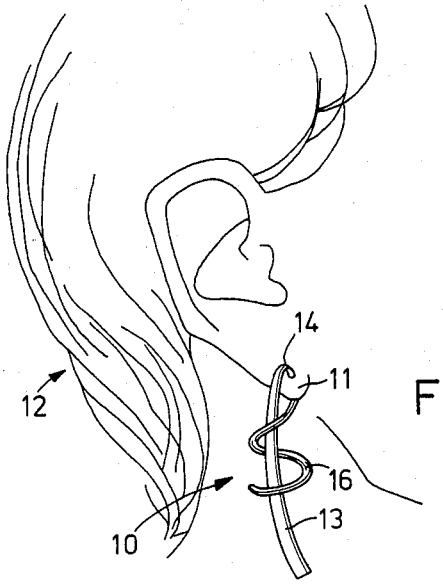
FIG. 1 is a view of an earring according to the invention, as it hangs on the ear of a wearer, viewed from the wearer's right side.

In the drawings, FIG. 1 shows an earring 10 positioned through a pierced ear 11 of a wearer 12. The earring 10, as illustrated in FIGS. 1 through 5, includes a central pendant portion 13, a curving apex portion 14 and a spiral portion 16 extending integrally down from the apex portion and curving through at least one spiral or helical revolution, around the central pendant portion 13. The integral apex and spiral portions may be formed of a piece of material having a substantially uniform cross section throughout its length. The term "spiral" as used herein and in the appended claims, is intended to embrace helical as well as spiral configurations.

As illustrated in the embodiment of FIGS. 1 through 5, the earring 10 may be formed of a single integral piece of material (such as gold, silver or other metal, or plastic), the spiral portion 16 and the apex portion 14 being round in cross-section, like a wire. The pendant portion 13 may be of any suitable decorative configuration, for example curved in its length and flattened in cross section as shown, but it must pass generally centrally through the space defined by the spiral 16.

Figure 2:
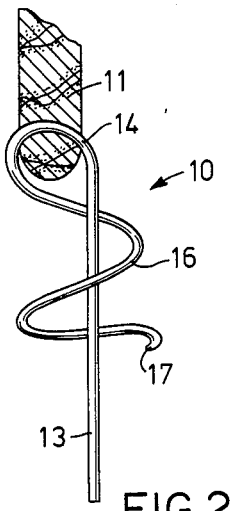
FIG. 2 is a sectional view, again showing the earring hanging in the ear, as viewed generally from the wearer's rear side.
Figure 3:
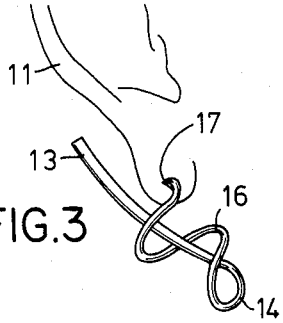
FIGS. 3, 4 and 5 show the manner of insertion of the earring into the ear.
Figure 4:
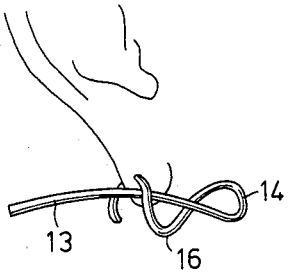
Figure 5:
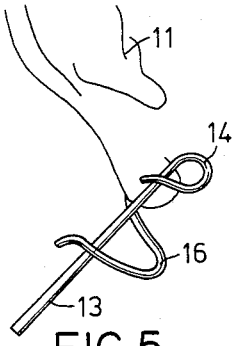

FIGS. 3, 4 and 5 illustrate the manner in which the earring 13 is placed on the ear. The lower end 17 of the spiral portion 16 is inserted through the pierce-hole of the ear 11, then the spiral portion 16 is progressively fed through the hole in a spiral or generally helical motion, revolving around the central pendant portion 13. FIG. 5 shows the earring with the apex portion 14 approaching the pierce-hole, and FIGS. 1 and 2 show the earring fully in place, with the apex portion 14 positioned through the ear. The spiral portion 16 thus serves as a form of hanger wire for the earring, while also comprising an important part of the ornamentation.

It can be seen that the spiral portion 16 is spaced away from the central pendant 13 sufficiently to permit the spiral portion to be fed through the ear. The flexibility and springing movability of the pendant 13 also helps facilitate this fitting of the earring onto the ear.

Figure 6:
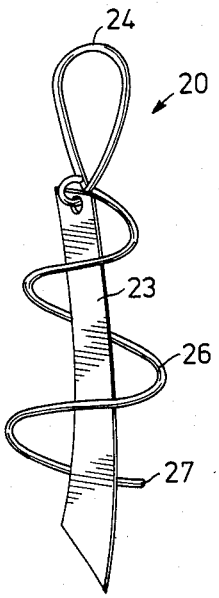
FIGS. 6, 7 and 8 show alternative embodiments of an earring according to the invention.
Figure 7:
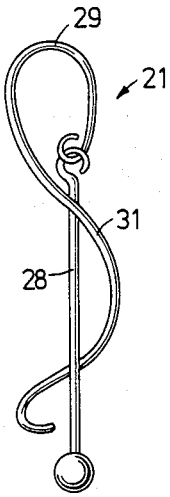
Figure 8:
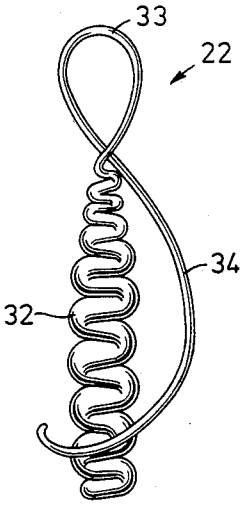

FIGS. 6, 7 and 8 show additional embodiments of earrings 20, 21 and 22, respectively, according to the invention. The earring 20 of FIG. 6 includes a central pendant 23 which is attached to, but not integral with an apex portion 24. As in the earring 10, the apex portion 24 is integrally formed with a spiral portion 26, which passes through more revolutions in this embodiment and terminates in an insertion end 27.

FIG. 7 shows another embodiment 21 with a rod-like central pendant 28, again connected to an apex portion 29 which curves into a long spiral portion 31. The earring 22 of FIG. 8 has a chain or similar ornament 32 as a central pendant, connected to an apex portion 33 curving into a spiral portion 34.

The preferred embodiment described herein is intended to be purely illustrative, and not limiting of the scope of the invention. Other embodiments and variations will be apparent to those skilled in the art and may be made without departing from the essence and scope of the invention as defined in the following claims.

I claim:

1. An earring for pierced ears, comprising a central pendant portion adapted to hang down from the ear and which forms one end of the earring, a curved apex portion extending from the top of the pendant portion, and a spiral portion integral with and extending down from the apex portion and having at least one spiral revolution circumjacent the central pendant portion, said spiral portion comprising both a hanger wire for the earring and an ornamental portion of the earring, terminating in a lower end which forms the other end of the earring, said lower end and spiral portion being insertable through the ear, up to the apex portion, for attaching the earring to the ear.

2. The earring of claim 1, wherein the central pendant portion is integral with the apex portion and the spiral portion.

3. The earring of claim 2, wherein the central pendant portion is of an elongated, flat configuration.

4. The earring of claim 1, wherein the central pendant portion comprises an elongated, generally flat pendant connected to a depending end of the apex portion.

5. The earring of claim 1, wherein the spiral portion has at least two spiral revolutions.

* * * * *